US006732041B2

(12) United States Patent
Cullen

(10) Patent No.: US 6,732,041 B2
(45) Date of Patent: May 4, 2004

(54) METHOD AND SYSTEM FOR INFERRING INTAKE MANIFOLD PRESSURE OF A VARIABLE COMPRESSION RATIO ENGINE

(75) Inventor: Michael John Cullen, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 103 days.

(21) Appl. No.: 10/063,462

(22) Filed: Apr. 25, 2002

(65) Prior Publication Data

US 2003/0204303 A1 Oct. 30, 2003

(51) Int. Cl.[7] ..... G06G 19/00; F02D 15/00

(52) U.S. Cl. ..... 701/103; 123/78 E

(58) Field of Search ..... 123/48 R, 48 A, 123/48 AA, 48 B, 48 C, 48 D, 78 R, 78 AA, 78 A, 78 B, 78 BA, 78 C, 78 D, 78 E, 78 F, 198 F, 316, 90.15, 90.16, 90.17; 701/101, 102, 103, 110, 111, 114, 115; 73/117.3, 118.1

(56) References Cited

U.S. PATENT DOCUMENTS 4,469,055 A 9/1984 Caswell ..... 123/78 B
4,805,571 A 2/1989 Humphrey ..... 123/316
4,834,031 A 5/1989 Katoh et al. ..... 123/48 R
4,860,711 A 8/1989 Morikawa ..... 123/48 D
5,165,368 A 11/1992 Schechter ..... 123/48 B
5,255,637 A 10/1993 Schechter ..... 123/48 R
5,287,827 A 2/1994 Almendinger et al. .... 123/46 R
5,568,795 A * 10/1996 Robichaux et al. ..... 123/198 F
5,595,146 A 1/1997 Bollig et al. ..... 123/48 B
5,682,854 A 11/1997 Ozawa ..... 123/316
5,791,302 A 8/1998 Ma ..... 123/48 B
5,819,702 A 10/1998 Mendler ..... 123/311
5,862,790 A 1/1999 Dai et al. ..... 123/316
5,970,943 A * 10/1999 Robichaux et al. ..... 123/198 F
6,125,801 A 10/2000 Mendler ..... 123/48 R
6,425,373 B1 * 7/2002 Robichaux et al. ..... 701/103
6,453,854 B1 * 9/2002 Baeuerle et al. ..... 123/78 E
6,499,449 B2 * 12/2002 Michelini et al. ..... 123/198 F

* cited by examiner

*Primary Examiner*—Willis R. Wolfe
(74) *Attorney, Agent, or Firm*—Dykema Gossett PLLC; Carlos Hanze

(57) ABSTRACT

A method for operating a variable compression ratio internal combustion engine includes the steps of determining a compression ratio operating state of the engine and inferring the air pressure within the engine's intake manifold, based at least in part on the compression ratio operating state of the engine.

10 Claims, 3 Drawing Sheets

METHOD AND SYSTEM FOR INFERRING INTAKE MANIFOLD PRESSURE OF A VARIABLE COMPRESSION RATIO ENGINE

BACKGROUND OF INVENTION

1. Field of the Invention

The present invention relates generally to variable compression ratio internal combustion engines. More particularly, the invention relates to a method and system for determining the pressure of air within an intake manifold ("manifold pressure") of a variable compression ratio internal combustion engine.

2. Background Art

The "compression ratio" of an internal combustion engine is defined as the ratio of the cylinder volume when the piston is at bottom-dead-center (BDC) to the cylinder volume when the piston is at top-dead-center (TDC). Generally, the higher the compression ratio, the higher the thermal efficiency and fuel economy of the internal combustion engine. So-called "variable compression ratio" internal combustion engines have been developed, for example, having higher compression ratios during low load conditions and lower compression ratios during high load conditions. Various techniques have been disclosed for varying compression ratio, including for example, using "sub-chambers and "sub-pistons" to vary the volume of a cylinder, see for example patents U.S. Pat. No. 4,246,873 and U.S. Pat. No. 4,286,552; varying the actual dimensions of all or a portion of a piston attached to a fixed length connecting rod, see U.S. Pat. No. 5,865,092; varying the actual length of the connecting rod itself, see U.S. Pat. Nos. 5,724,863 and 5,146,879; and using eccentric rings or bushings either at the lower "large" end of a connecting rod or the upper "small" end of the connecting rod for varying the length of the connecting rod or height of the reciprocating piston. See U.S. Pat. No. 5,562,068, U.S. Pat. No. 5,960,750, U.S. Pat. No. 5,417,185 and Japanese Publication JP-03092552.

As with conventional internal combustion engines, it is vitally important for a number of reasons to be able to accurately estimate or infer the air pressure within the intake manifold of a variable compression ratio internal combustion engine. Manifold pressure estimates are used, for example, to operate intake manifold filling models, and to properly control an electronic throttle, to name but two functions.

The inventor herein has recognized the need to accurately determine the manifold pressure as a function of a selected engine compression ratio in order to ensure optimal control and performance of the engine and the vehicle systems.

SUMMARY OF INVENTION

A method is provided for operating a variable compression ratio internal combustion engine. The method includes the steps of determining a compression ratio operating state of the variable compression ratio internal combustion engine, and inferring the engine's intake manifold pressure based at least in part on the compression ratio operating state of the engine. For example, in accordance with the present invention, manifold pressure can be inferred by first determining the engine speed, engine load, and the current compression ratio operating state of the engine. The manifold pressure is determined by first extracting an intercept pressure value from an intercept lookup table as a function of engine speed and compression ratio. This value is summed with a slope pressure value determined as the product of engine load and a slope selected from a slope lookup table as a function of engine speed and compression ratio. If the compression ratio is subsequently changed, a new value for manifold pressure may be extracted from a second lookup table using the same inputs, with the exception of compression ratio, as were used with the first table. Alternatively, one or more scalar values may be applied to the appropriate value extracted from the baseline lookup table.

Advantageously, the methods described herein allow for improved estimates of manifold pressure that can be used to optimize scheduling of compression ratio operating states in a variable compression ratio internal combustion engine. The methods disclosed herein are useful for optimizing the fuel economy benefits of the engine, while at the same time improving control and performance of a corresponding motor vehicle.

In accordance with a related aspect of the present invention, a corresponding system is provided for operating a variable compression ratio internal combustion engine. The system includes a compression ratio setting apparatus for configuring the engine in selected ones of the compression ratio operating states, and a controller in communication with the sensors and the compression ratio apparatus, the controller comprising computer program means for inferring manifold pressure based at least in part on the compression ratio operating state of the engine. A system in accordance with a preferred embodiment further comprises a sensor coupled to the engine for generating a signal representative of engine speed, a sensor system coupled to the engine for generating a signal representative of engine load; and computer program code and look-up tables for determining at least one predefined exhaust temperature based at least upon on the engine speed, the engine load, and the compression ratio operating state of the engine.

Further advantages, as well as objects and features of the invention will become apparent from the following detailed description of the invention taken in conjunction with the accompanying figures showing illustrative embodiments of the invention.

BRIEF DESCRIPTION OF DRAWINGS

For a complete understanding of the present invention and the advantages thereof, reference is now made to the following description taken in conjunction with the accompanying drawings in which like reference numerals indicate like features wherein.

DETAILED DESCRIPTION

Figure 1:
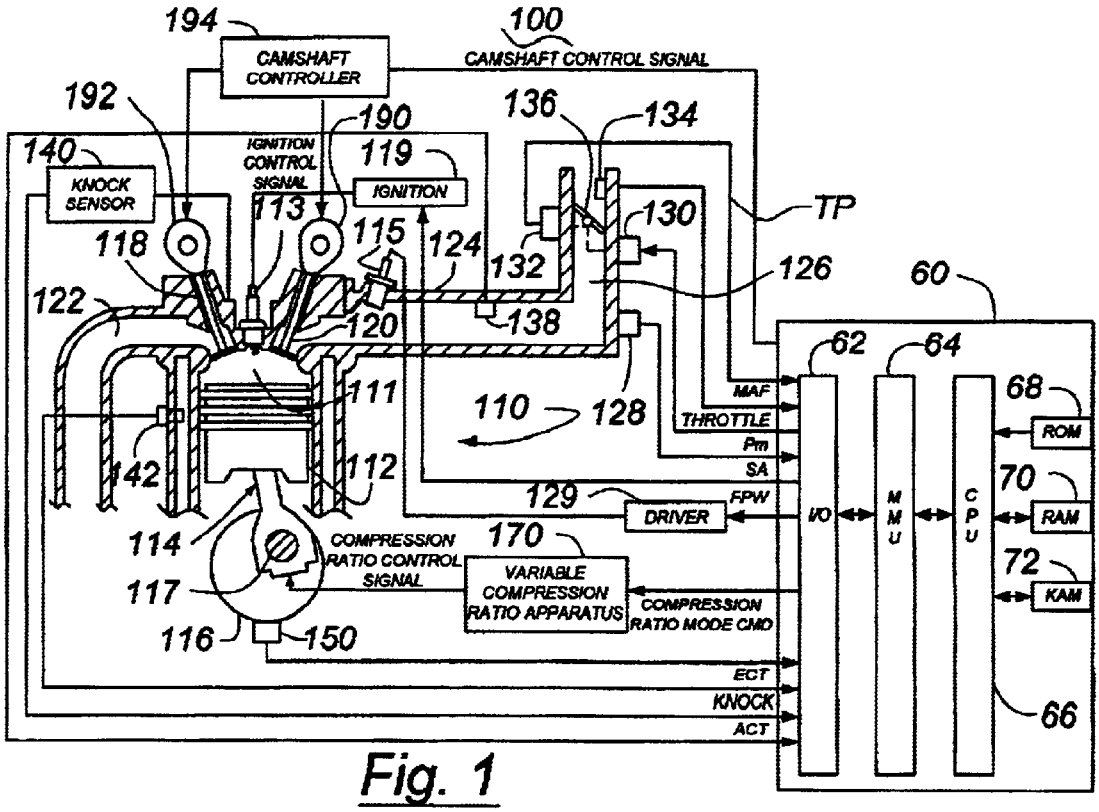
FIG. 1 is a diagram of an exemplary variable compression ratio internal combustion engine in accordance with the present invention.

FIG. 1 shows an exemplary variable compression ratio internal combustion engine in accordance with the present invention. As will be appreciated by those skilled in the art in view of this disclosure, the present invention is independent of the particular underlying engine configuration and component designs, and as such can be used with a variety of different internal combustion engines having more than one compression ratio operating modes. The engine for example can be constructed and operated as a discrete compression ratio engine operating for example at a high compression or at low compression, or as a continuously variable compression ratio engine capable of operating at any number of discrete or selected compression ratios. Similarly, the present invention is not limited to any particular type of apparatus or method required for setting or varying the compression ratio of the internal combustion engine.

Referring again to FIG. 1, engine 110 includes a plurality of cylinders (only one shown), each having a combustion chamber 111, a reciprocating piston 112, and intake and exhaust valves 120 and 118 for communicating the combustion chamber 111 with intake and exhaust manifolds 124 and 122. The intake valves are actuated by intake camshaft 190 and the exhaust valves are driven by exhaust camshaft 192. The phasing of camshafts 190 and 192 is controlled by camshaft controller 194, which receives signals from the electronic engine controller described below.

Continuing with FIG. 1, piston 112 is coupled to a connecting rod 114, which itself is coupled to a crankpin 117 of a crankshaft 116. Fuel is provided to the combustion chamber 111 via a fuel injector 115 and is delivered in proportion to a fuel pulse width (FPW) determined by an electronic engine or vehicle controller 60 (or equivalent microprocessor-based controller) and electronic driver circuit 129. Air charge into the intake manifold 124 is nominally provided via an electronically controlled throttle plate 136 disposed within throttle body 126. Ignition spark is provided to the combustion chamber 111 via spark plug 113 and ignition system 119 in accordance with a spark advance (or retard) signal (SA) from the electronic controller 60.

As shown in FIG. 1, the controller 60 nominally includes a microprocessor or central processing unit (CPU) 66 in communication with computer readable storage devices 68, 70 and 72 via memory management unit (MMU) 64. The MMU 64 communicates data (including executable code instructions) to and from the CPU 66 and among the computer readable storage devices, which for example may include read-only memory (ROM) 68, random-access memory (RAM) 70, keep-alive memory (KAM) 72 and other memory devices required for volatile or non-volatile data storage. The computer readable storage devices may be implemented using any known memory devices such as programmable read-only memory (PROM's), electrically programmable read-only memory (EPROM's), electrically erasable PROM (EEPROM's), flash memory, or any other electrical, magnetic, optical or combination memory devices capable of storing data, including executable code, used by the CPU 66 for controlling the internal combustion engine and/or motor vehicle containing internal combustion engine 110. Input/output (I/O) interface 62 is provided for communicating with various sensors, actuators and control circuits, including but not limited to the devices shown in FIG. 1. These devices include an engine speed sensor 150, electronic fuel control driver 129, ignition system 119, manifold absolute pressure sensor (MAP) 128, mass air flow sensor (MAF, "airmeter") 134, throttle position sensor 132, electronic throttle control motor 130, inlet air temperature sensor 138, engine knock sensor 140, and engine coolant temperature 142.

The engine 110 of FIG. 1 also includes and a variable compression ratio ("compression ratio setting") apparatus 170. In a non-limiting embodiment, the variable compression ratio apparatus 170 is operated to vary the effective length of the connecting rod 114, and thus the clearance volume and compression ratio of the engine. Such an apparatus is described, for example, in U.S. application Ser. No. 09/682,263, entitled "Connecting Rod for a Variable Compression Engine," which is owned by the assignee of the present invention and is hereby incorporated by reference in its entirety. The actual construction and configuration of the variable compression apparatus shown in FIG. 1 is not at all intended to limit the scope of claim protection for the inventions described herein.

In a non-limiting aspect of the present invention, the variable compression ratio apparatus of FIG. 1 is described below as operating in a "high" compression ratio mode (compression ratio of 13:1 and above) or a "low" compression ratio mode (compression ratio of 11:1 and below).

Figure 2:
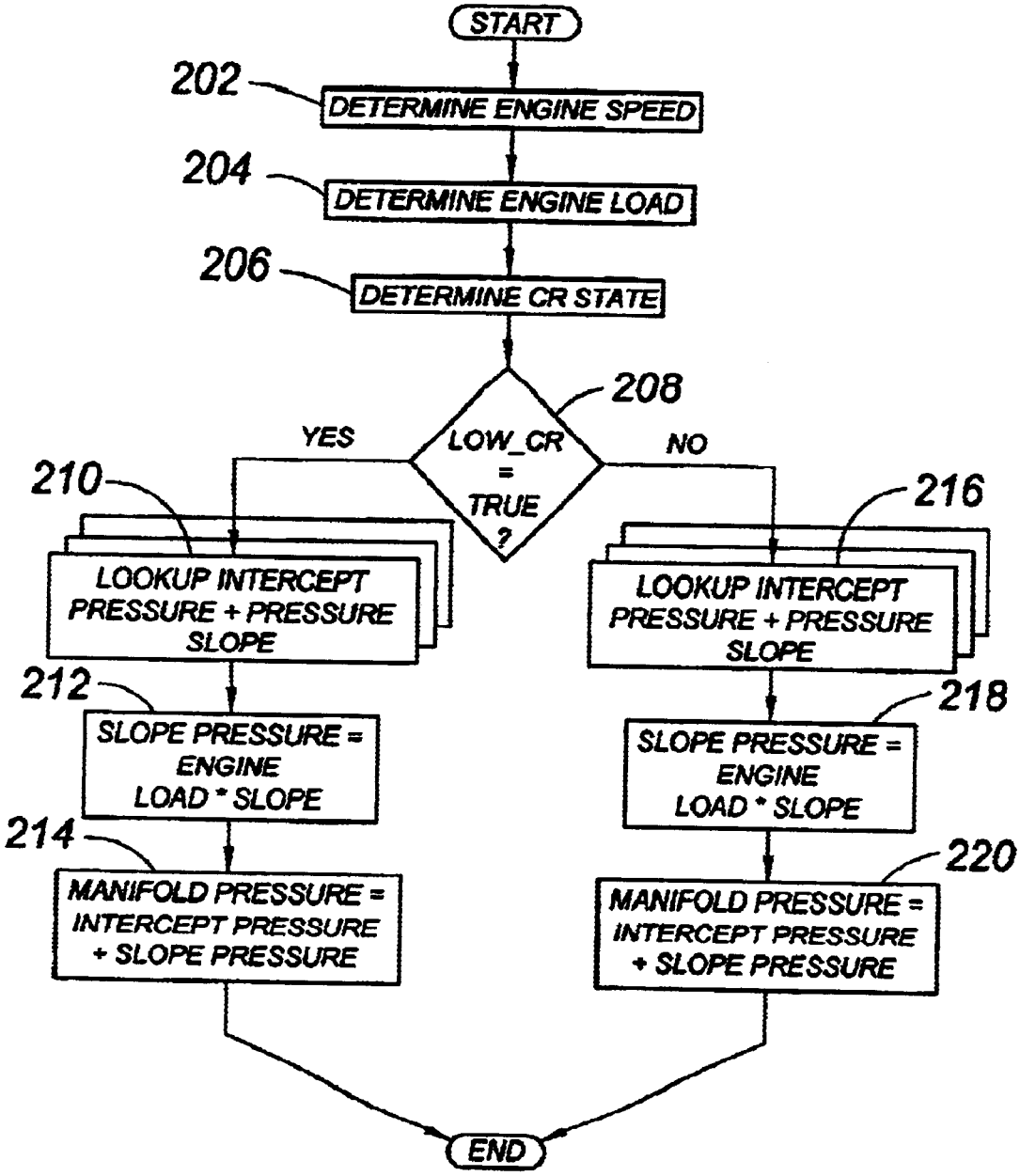
FIG. 2 is a flow diagram of a preferred method for operating a discretely variable compression ratio internal combustion engine in accordance with the present invention.
Figure 3:
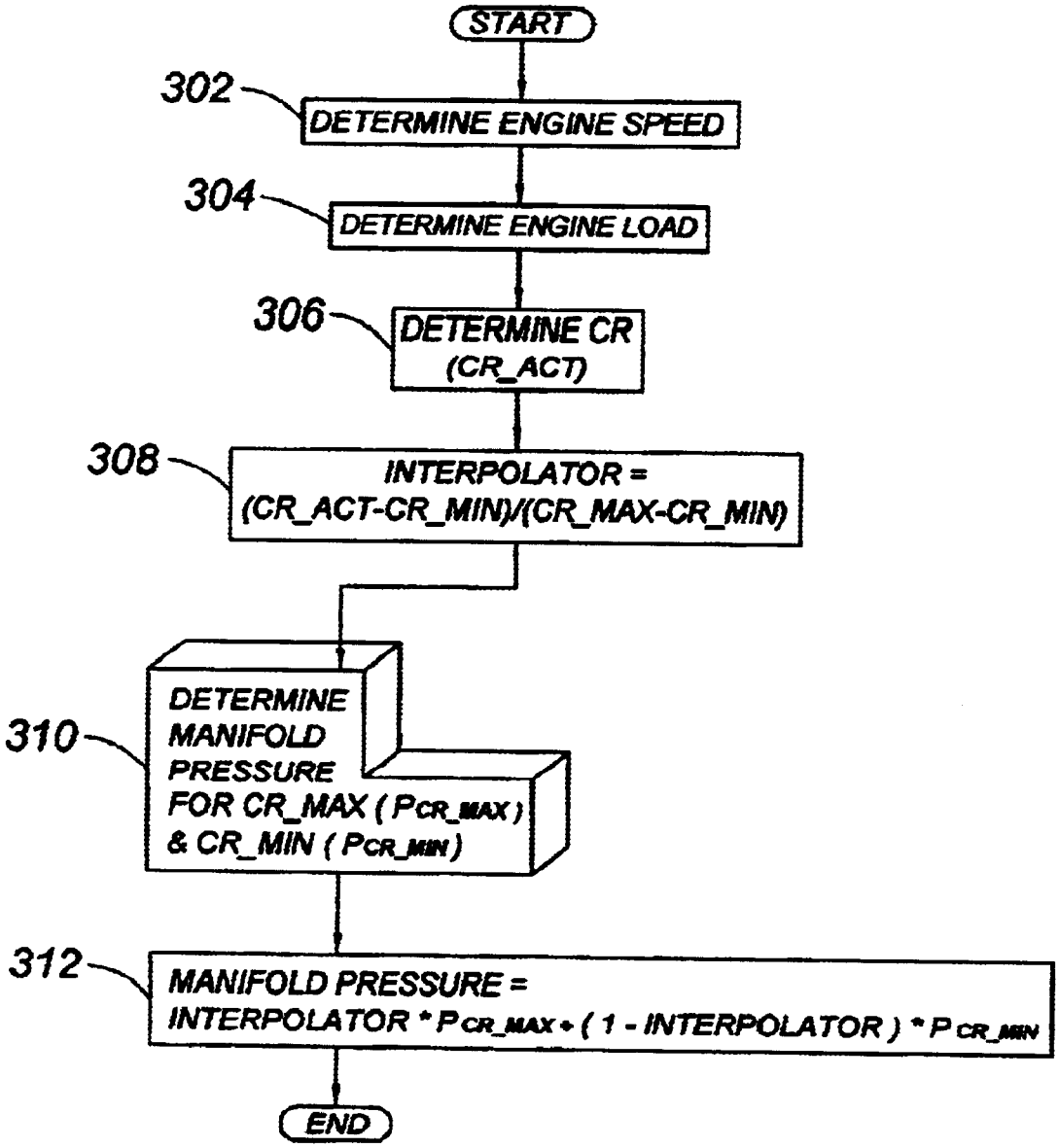
FIG. 3 is a flow diagram of a preferred method for operating a continuously variable compression ratio internal combustion engine in accordance with the present invention.

FIGS. 2 and 3 show flow diagrams of preferred methods for operating a variable compression ratio internal combustion engine in accordance with the present invention. The method of FIG. 2 is applicable to variable compression ratio internal combustion engines operating in discrete compression ratio states, for example the engine described above with reference to FIG. 1, and the method of FIG. 3 is applicable to a continuously variable compression ratio internal combustion engine having for example "HIGH" and "LOW" states representing minimum and maximum limits on a continuous range of compression ratio states. The scope of the present invention however is not intended to be limited to a particular type of engine or compression ratio setting apparatus.

Referring now to FIG. 2, a preferred method for operating a discretely variable compression ratio internal combustion engine includes the steps of determining the rotational speed ($RPM_{eng}$ or engine_speed) of the engine, step 202, and determining the engine load, step 204. At step 206, the compression ratio operating state of the engine is determined.

Those skilled in the art will appreciate in view of this disclosure that a variety of hardware and software schemes may be implemented to determine the values of the various engine operating parameters needed to operate a system and method according to the present invention. For example, engine_speed can be determined using a speed sensor coupled to an engine crankshaft, or by using any other method known in the art. Engine load may be determined using any known method, including known methods employing throttle position sensing. A MAF sensor is disposed in the engine's air intake manifold as shown at 132 in FIG. 1. Camshaft phasing may be determined by interrogating camshaft controller 194. Finally, the compression ratio operating mode can be determined using any of the known methods, including using a combustion pressure sensor disposed in one or more of the cylinders, or by using a piston position sensor or other sensor coupled to the engine and/or the compression ratio setting apparatus of the engine. The compression ratio operating state can also be derived or inferred using any suitable method known to those skilled in the art and suggested by this disclosure.

Next, if the engine is operating in a low compression mode (Low_CR=TRUE), step 208, then controller 60 proceeds to step 210, wherein lookup tables are entered using the previously determined values for engine speed and load and compression ratio state. For the purposes of this specification, intercept pressure means intake manifold pressure as a function of engine speed, and if so equipped, camshaft phaser position. Pressure slope is also a function of engine speed and camshaft phase. In step 212, slope pressure is calculated as the product of pressure slope and engine load. Finally, in step 214, manifold pressure is determined as the sum of intercept pressure and slope pressure.

If the answer at step 208 is "no", the engine is operating at a high compression ratio, and steps 216–220 will follow. These steps follow the same form and sequence as steps 210–214, with it being understood that a different set of lookup tables is used for the higher compression ratio.

FIG. 3 duplicates FIG. 2 for steps 302–304. Thereafter, at step 306, the actual compression ratio is determined from the range of possible ratios extending from the lowest to the highest compression. At step 308, a compression ratio interpolator is calculated as the fraction representing the actual increase in compression ratio divided by the maximum possible change in compression ratio. Thereafter, at step 310, manifold pressures are determined for maximum compression ratio (CR_MAX, Pcr_max). and minimum compression ratio (CR_MIN, Pcr_min.). Pcr_max and Pcr_min are determined using the steps described in connection with steps 210–214 of FIG. 2. Finally, at step 312 manifold pressure is calculated according to Equation 1:

$$\text{manifold pressure} = \text{INTERPOLATOR} * \text{Pcr_max} + (1 - \text{INTERPOLATOR}) * \text{Pcr_min} \quad \text{Eq. (1)}$$

The process of FIG. 3 allows manifold pressure to be precisely determined with engines having infinitely adjustable compression ratio control systems.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed is:

1. An article of manufacture for operating an internal combustion engine having a plurality of compression ratio operating states, the article of manufacture comprising:

a computer usable medium; and a computer readable program code embodied in the computer usable medium for inferring intake manifold pressure of the engine based at least in part on the compression ratio operating state of the engine.

2. A system for operating an internal combustion engine having a plurality of compression ratio operating states, the system comprising:

a compression ratio setting apparatus for configuring the engine in selected ones of the compression ratio operating states; and a controller in communication with a plurality of engine operating parameter sensors and said compression ratio apparatus, said controller comprising computer program means for inferring an intake manifold pressure for the engine based at least in part on the compression ratio operating state of the engine.

3. A system according to claim 2, further comprising:

a sensor coupled to the engine for generating a signal representative of engine speed;

a sensor coupled to the engine for generating a signal representative of throttle position;

wherein computer program means for inferring intake manifold pressure comprises computer program means for determining at least one predefined intake manifold pressure value based on engine speed and load, as determined from the throttle position, and the compression ratio operating state of the engine.

4. A method for operating a variable compression ratio internal combustion engine, comprising:

determining a compression ratio operating state of the engine; and inferring an intake manifold air pressure for the engine based at least in part on the compression ratio operating state of the engine.

5. A method according to claim 4, further comprising:

determining an operating speed of the engine;

determining the load at which the engine is operating; and wherein the step of inferring the intake manifold pressure comprises the step of determining at least one predefined intake manifold pressure based on the engine speed, the engine load, and the compression ratio operating state of the engine.

6. A method according to claim 5, wherein intake manifold pressure is interpolated as a function of actual compression ratio, with said interpolation being applied to the difference between a first manifold pressure value corresponding to the engine's maximum compression ratio and a second manifold pressure value corresponding to the engine's minimum compression ratio, wherein the actual compression ratio lies between the maximum and minimum compression ratios.

7. A method according to claim 5, further comprising the step of determining phasing of a camshaft and using the determined value of camshaft phasing to infer the intake manifold pressure.

8. A method according to claim 5, further comprising the step of determining the operating position of an intake manifold runner control valve and using said determined operating position to infer the intake manifold pressure.

9. A method according to claim 5, wherein intake manifold pressure is determined as an intercept pressure value selected from an intercept lookup table as a function of engine speed and compression ratio, with intercept pressure value being summed with a slope pressure value determined as the product of engine load and a slope selected from a slope lookup table as a function of engine speed and compression ratio.

10. A method according to claim 9, wherein intake manifold pressure is determined as an intercept pressure value selected from an intercept lookup table as a function of engine speed, compression ratio, and camshaft phase position, with the intercept pressure value being summed with a slope pressure value determined as the product of engine load and a slope selected from a slope lookup table as a function of engine speed, compression ratio, and camshaft phase position.

* * * * *